US006819882B2

(12) United States Patent
Hashimoto

(10) Patent No.: US 6,819,882 B2
(45) Date of Patent: Nov. 16, 2004

(54) POWDER STIRRING DEVICE

(75) Inventor: Toshifumi Hashimoto, Yokohama (JP)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/314,169

(22) Filed: Dec. 9, 2002

(65) Prior Publication Data

US 2004/0109701 A1 Jun. 10, 2004

(51) Int. Cl.[7] ..... G03G 15/08
(52) U.S. Cl. ..... 399/27; 399/254; 399/258
(58) Field of Search ..... 399/27, 64, 254, 399/255, 258, 263, 256, 272, 281, 53; 366/325.94

(56) References Cited

U.S. PATENT DOCUMENTS 5,189,474 A * 2/1993 Miya et al. ..... 399/255
5,287,151 A 2/1994 Sugiyama ..... 399/258
5,701,563 A * 12/1997 Fukuda et al. ..... 399/284
6,424,812 B1 * 7/2002 Hsu ..... 399/262
6,591,079 B2 7/2003 Ota et al. ..... 399/262

FOREIGN PATENT DOCUMENTS

JP 60-238874 A * 11/1985
JP 3-217879 9/1991
JP 11-143201 A * 6/1999
JP 11-231634 A * 8/1999

* cited by examiner

*Primary Examiner*—Sophia S. Chen
(74) *Attorney, Agent, or Firm*—Staas & Halsey LLP

(57) ABSTRACT

A powder stirring device which has a simple structure and can effectively stir toner. A stirring pin in a reserve tank has a middle space and includes pin elements. When the stirring pin rotates, toner in the reserve tank is stirred by the pin elements. The toner is diffused through the middle space between the pin elements and is sufficiently mixed with air, thus becoming powdery. The stirred powder-type toner is spread in the reserve tank and is provided to a development unit.

22 Claims, 6 Drawing Sheets

POWDER STIRRING DEVICE

BACKGROUND OF THE INVENTION

1. Field of the Invention

The present invention relates to a powder stirring device used in an image forming device, such as a photocopier or a printer.

2. Description of the Related Art

An image forming device, such as a photocopier or a printer, develops images in the following way. First, images are optically read and electrostatic images are formed on the surface of a photosensitive body. Next, powder-type toner is attached to the electrostatic images and is then transferred to a piece of paper. Such a process of developing images is performed in a development unit included in an image forming device.

In general, toner is contained in a toner cartridge under a predetermined pressure to be maintained in a solid state. Powder-type toner can be provided to a development unit after transferring the toner from the toner cartridge to a reserve tank to supply toner and then stir it with a powder stirring device in the reserve tank. An image forming device having such a structure has been disclosed in Japanese Patent Laid-Open Publication No. hei 3-217879. Here, the toner cartridge and the reserve tank may be integrated into one body or may be used separately.

FIG. 1 is a diagram illustrating a conventional image forming device, such as a printer. Referring to FIG. 1, toner contained in a toner cartridge 31 is provided to a reserve tank 32 and stirred therein so that it becomes powdery. Next, the toner is provided from a supply roller 33 of the reserve tank 32 to a development unit 34. The fine-grained toner is attached to electrostatic images formed on a drum of the development unit 34 and is finally transferred to a piece of paper as an image.

In order to regularly attach toner to the electrostatic images formed on the drum of the development unit 34, the amount of the toner needs to be controlled by stirring the toner in the reserve tank 32 with air, in order to reach a powdery state and thus the toner regularly spreads in the direction of the length of the supply roller 33. Accordingly, a powder stirring device to stir toner and convey it in the direction of the length of the supply roller 33 is installed in the reserve tank 32.

FIG. 2 is a diagram illustrating the structure of a conventional reserve tank. Referring to FIG. 2, when grain-type toner is supplied from a toner discharger 42 formed at the lower part of a toner cartridge 41 to a toner supplier 44 formed at the surface of a reserve tank 43, the grain-type toner is mixed with air by two stirring screws 45 and 46 so that it becomes powdery.

The powdery toner is circulated by the two stirring screws 45 and 46 so that it can be repeatedly moved along the direction of the length of the reserve tank 43 and can be regularly spread to the reserve tank 43, as marked by the arrows in FIG. 2. The toner stirred by the stirring screws 45 and 46 is sent to a development unit (not shown) for development. A supply roller 47 is installed near the stirring screw 45 to supply toner to the development unit. The amount of toner in the reserve tank 43 is measured by a toner sensor 48, which includes a piezoelectric vibrator, so that a certain amount of toner required for development can always be saved in the reserve tank 43.

However, in the structure of the conventional powder stirring device, toner cannot be effectively stirred because the toner may attach to the surface of the stirring screws 45 and 46. In particular, in the case of a small-sized image forming device, since the capacities of a reserve tank 43 and the amount of air in the reserve tank 43 are very small, toner may more easily attach to the surface of the stirring screws 45 and 46, and thus it is much more difficult to effectively stir the toner with air. In addition, the stirring screws 45 and 46 have a very complicated structure and are very expensive. It is also very difficult to manufacture the stirring screws 45 and 46 to be compact.

In the case of an image forming device, such as a printer, since the reserve tank 43 has a small capacity, toner in the reserve tank 43 is used up faster, and thus it is necessary to frequently detect how much toner is left in the reserve tank 43. However, a piezoelectric sensor, which is conventionally used as a toner sensor 48, measures the amount of toner based on vibration frequencies that vary depending on the amount of toner attached to the piezoelectric sensor, and thus it is impossible to measure the amount of toner in real time. In other words, a small-sized image forming device, such as a printer, has a small reserve tank and can print images very quickly. However, it is almost impossible to maintain an appropriate amount of toner in the reserve tank 43, unless the amount of toner in the reserve tank is measured often.

SUMMARY OF THE INVENTION

Accordingly, it is an aspect of the present invention to provide a powder stirring device which has a simple structure and can effectively stir toner.

It is another aspect of the present invention to provide a powder stirring device which measures the amount of toner left in a reserve tank in real time.

Additional aspects and advantages of the invention will be set forth in part in the description which follows and, in part, will be obvious from the description, or may be learned by practice of the invention.

The foregoing and/or other aspects of the present invention may be achieved by providing a powder stirring device, which stirs toner to be provided to a development unit of an image forming device. The powder stirring device includes a stirring element which is supported in a reserve tank, temporarily storing the toner. The stirring element is arranged away from a rotation axis of the reserve tank or a region adjacent to the rotation axis, so as to be capable of rotating in the reserve tank.

The stirring element may be formed in a bar shape and arranged in parallel with the rotation axis of the reserve tank. The stirring element may be formed in a crank or a spiral shape.

The stirring device may include a pair of bars, which are symmetrically arranged with respect to the rotation axis of the reserve tank and are parallel to the rotation axis of the reserve tank, and ribs, which are formed along the rotation circumference of the pair of bars and are slantingly connected to the pair of bars.

The powder stirring device may further include a unit to detect the amount of toner in the reserve tank. The unit to detect the amount of toner in the reserve tank may be an optical sensor which detects the amount of light passing through a region in the reserve tank where toner is stirred.

The powder stirring device may further include a supply roller which is provided in the vicinity of the stirring element to provide toner to the development unit. The stirring element may be arranged so that its rotation circumference contacts the supply roller.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
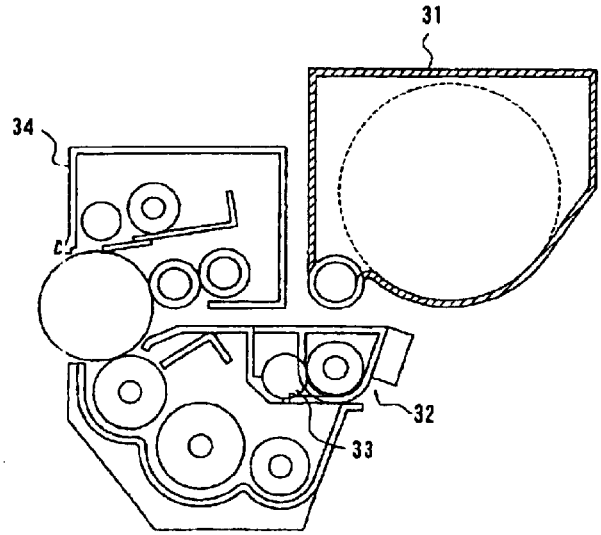
FIG. 1 (PRIOR ART)
FIG. 1 is a diagram illustrating a conventional image forming device, such as a printer.

Reference will now be made in detail to the present preferred embodiments of the present invention, examples of which are illustrated in the accompanying drawings, wherein like reference numerals refer to like elements throughout.

Figure 3:
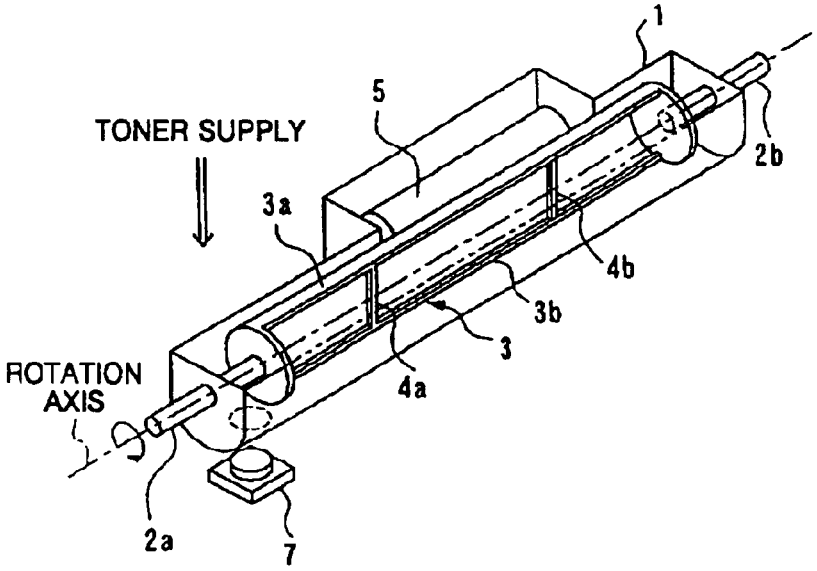
FIG. 3 is a diagram illustrating a reserve tank and a stirring pin according to a first embodiment of the present invention.

FIG. 3 is a diagram illustrating the structure of a reserve tank, in which a powder stirring device according to a first embodiment of the present invention is installed. Referring to FIG. 3, a reserve tank 1 is installed in a development unit (not shown). The reserve tank 1 temporarily stores toner supplied from a toner cartridge (not shown) while stirring it.

The development unit and toner cartridge 31 of the present invention may be similar to the development unit 34 and toner cartridge 31 of FIG. 1

As shown in FIG. 3, the reserve tank 1 is an almost rectangular container, and shafts 2*a* and 2*b* are attached to either end of the reserve tank 1, respectively, along the longitudinal axis of the reserve tank 1 so as to be able to rotate. A stirring pin 3 is installed in the reserve tank 1 so that it can rotate around the shafts 2*a* and 2*b*. The stirring pin 3 includes bar-shaped pin elements 3*a* and 3*b*. The pin elements 3*a* and 3*b* are installed in parallel with the shafts 2*a* and 2*b* at a predetermined distance from the rotation axis of the stirring pin 3, i.e., the longitudinal axis of shafts 2*a* and 2*b*. Accordingly, there exists a space between the pin elements 3*a* and 3*b* in the stirring pin 3. Reinforcing ribs 4*a* and 4*b* are installed apart from each other to be connected to the pin elements 3*a* and 3*b*. When the shafts 2*a* and 2*b* rotate, the stirring pin 3 rotates in the reserve tank 1 and stirs the toner in the reserve tank 1 with the pin elements 3*a* and 3*b*.

A supply roller 5 is installed near the stirring pin 3 parallel to the longitudinal axis of the reserve tank 1. The supply roller 5 supplies toner to a development unit (not shown). Since the supply roller 5 is formed of an elastic substance, such as sponge, toner stirred in the reserve tank 1 can be supplied to the development unit by rotating the supply roller 5.

A toner sensor 7 to detect the amount of toner left in the reserve tank 1 is provided at the bottom of the reserve tank 1. In the present embodiment, a piezoelectric sensor, such as a piezoelectric vibrator, is used as the toner sensor 7 by taking advantage of the fact that the vibration frequency of a piezoelectric vibrator varies depending on the amount of toner remaining in the reserve tank 1.

Embodiments in which an optical toner sensor is used will be described later.

In the reserve tank 1 having such a powder stirring device, the stirring pin 3 is rotated together with the shafts 2*a* and 2*b* by operating a motor (not shown), and the pin elements 3*a* and 3*b* installed at the circumference of the stirring pin 3 stir toner in the reserve tank 1. Toner particles stirred by the pin elements 3*a* and 3*b* are diffused through the middle space between the pin elements 3*a* and 3*b* so that air layers can effectively permeate among the toner particles, thus making the toner particles powdery.

Here, if the stirring pin 3 is formed in a plate shape without having the middle space between the pin elements 3*a* and 3*b*, toner particles attached to the stirring pin 3 during stirring just slide over the surface of the stirring pin 3. Accordingly, the toner particles can barely mix with air. On the other hand, in the case of the stirring pin 3 shown in FIG. 3, toner particles in the reserve tank 1 freely pass through the middle space of the stirring pin 3 such that they are more likely to effectively mix with air and become powdery.

Figure 2:
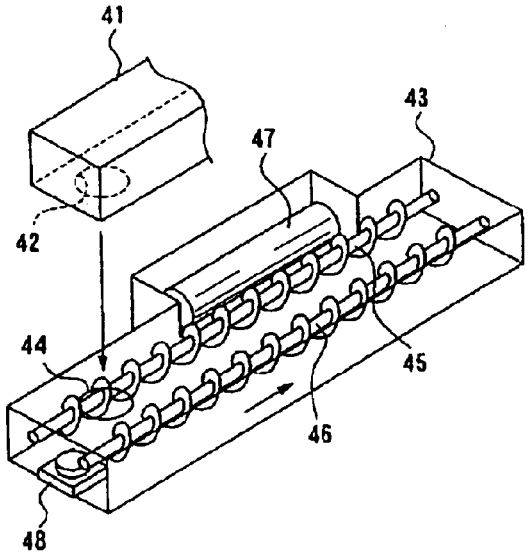
FIG. 2 (PRIOR ART)
FIG. 2 is a diagram illustrating the structure of a conventional reserve tank.

In particular, a small-sized image forming device, such as a printer, has a relatively small reserve tank. Accordingly, it is possible to evenly spread toner along the longitudinal axis of the reserve tank 1 by simply stirring it with the stirring pin 3 without the need for the stirring screws 45 and 46 shown in FIG. 2. In other words, toner particles are stirred by the stirring pin 3 having a middle space so that they can be diffused in every direction, and in particular, along the longitudinal axis of the reserve tank 1.

Thereafter, the toner stirred in the reserve tank 1 is supplied to a development unit (not shown) by the supply roller 5 to develop images.

In the present embodiment, the stirring pin 3 is formed to have a space in its middle portion along its rotation axis. However, the shafts 2*a* and 2*b* may be extended more along the rotation axis of the stirring pin 3, and the pin elements 3*a* and 3*b* may be installed around the shafts 2*a* and 2*b*, aside from the rotation axis of the stirring pin 3. As long as a space where toner can be effectively spread is provided within the rotation track of the pin elements 3*a* and 3*b*, the shafts 2*a* and 2*b* may be installed along the axis of the stirring pin 3.

According to the present embodiment, it is possible to control the stirring power of the pin elements 3*a* and 3*b* and the power of spreading toner particles by varying the rotation speed of the motor (not shown) and controlling the rotation speed of the stirring pin 3. In addition, the degree to which the toner particles in the reserve tank 1 are stirred can be varied by controlling the rotation speed of the motor according to the amount of toner particles remaining in the reserve tank 1.

Figure 4:
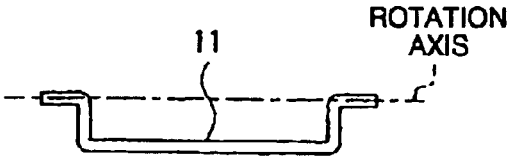
FIG. 4 is a diagram illustrating a stirring pin according to a second embodiment of the present invention.

FIG. 4 is a diagram illustrating a stirring pin 11 according to a second embodiment of the present invention. As shown in FIG. 4, the stirring pin 11 is formed in a crank shape, and either end of the stirring pin 11 is respectively fixed to shafts 2*a* and 2*b*. When the stirring pin 11 rotates, toner particles in the reserve tank 1 are effectively stirred and thus become powdery. The stirring pin 11 may be used in the reserve tank 1 shown in FIG. 3.

As compared with the stirring pin 3 in the first embodiment, the stirring pin 11 in the second embodiment has a simpler structure and can be installed in a small-sized reserve tank, and effectively stirs toner even though it has a weaker power of spreading toner particles than the stirring pin 3.

Figure 5:
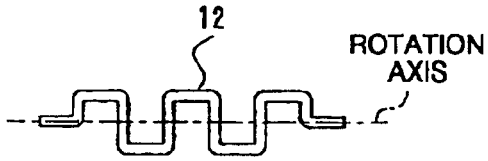
FIG. 5 is a diagram illustrating a stirring pin according to a third embodiment of the present invention.

FIG. 5 is a diagram illustrating a stirring pin 12 according to a third embodiment of the present invention. As shown in FIG. 5, the stirring pin 12 is a variation of the stirring pin 11 shown in FIG. 4. The stirring pin 12 is cranked in a sawtooth shape. The stirring pin 12 in the present embodiment has a strong power of stirring and spreading toner particles. In addition, the stirring pin 12 can be installed in a small-sized reserve tank, thus realizing a small-sized powder stirring device.

Figure 6:
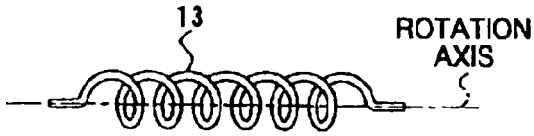
FIG. 6 is a diagram illustrating a stirring pin according to a fourth embodiment of the present invention.

FIG. 6 is a diagram illustrating a stirring pin 13 according to a fourth embodiment of the present invention. As shown in FIG. 6, the stirring pin 13 is formed in a spiral shape. When rotating the stirring pin 13 using either end of the stirring pin 13 as a rotation axis, the same power of stirring toner particles as in the first through third embodiments can be generated. At the same time, the rotating stirring pin 13 can also generate enough power to spread the toner particles.

According to the present embodiment, toner particles contained even in a large reserve tank can be effectively stirred and can be uniformly spread. A spiral pitch may be adequately determined depending on how much toner particles need to be stirred and spread.

Figure 7:
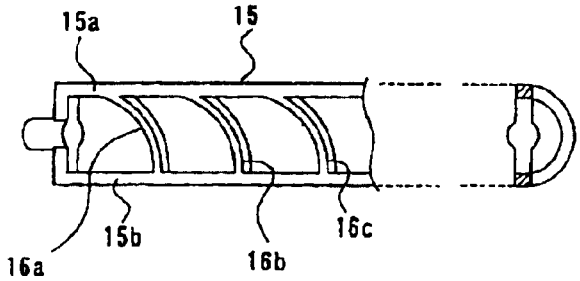
FIG. 7 is a diagram illustrating the front view and side view of a stirring pin according to a fifth embodiment of the present invention.

FIG. 7 is a diagram illustrating the front view and side view of a stirring pin 15 according to a fifth embodiment of the present invention. As shown in FIG. 7, the stirring pin 15 has spiral ribs 16*a*, 16*b*, 16*c*, . . . which are modified from the reinforcing ribs 4*a* and 4*b* shown in FIG. 1 into spiral semicircle shapes.

The stirring pin 15 has spaces along its rotation axis, and bar-shaped pin elements 15*a* and 15*b* are formed at the circumference of the stirring pin 15 along the longitudinal axis of the stirring pin 15. The spiral ribs 16*a*, 16*b*, 16*c*, . . . are installed at intervals of a certain pitch between the pin elements 15*a* and 15*b*.

According to the fifth embodiment of the present invention, like the first through fourth embodiments, the pin elements 15*a* and 15*b* can generate enough power to stir toner, and the spiral ribs 16*a*, 16*b*, 16*c*, . . . can generate enough power to spread the toner. Accordingly, it is possible to more effectively stir and spread the toner.

In the first through fifth embodiments, a piezoelectric sensor may be used as a toner sensor in which case a time lag may appear when detecting the amount of toner. However, an optical sensor which detects how much light passes through a certain region of the reserve tank 1 may instead be used.

Figure 8:
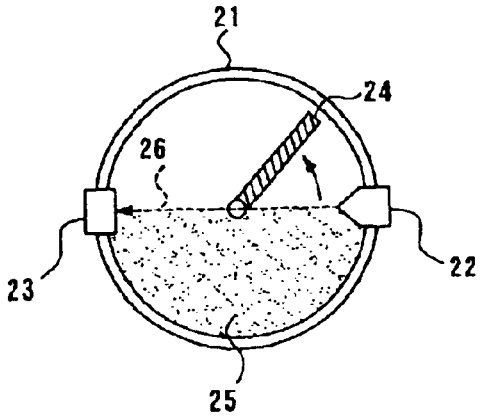
FIG. 8 is a diagram illustrating a toner sensor according to a sixth embodiment of the present invention.

FIG. 8 is a diagram illustrating the concept of an optical sensor which is used as a toner sensor. Here, the optical sensor may be an irradiation-type photosensor including a light-radiation device and a light-reception device. Alternately, the sensor may be a reflection-type photosensor having a device into which a light-radiation device and a light-reception device are integrated, with a light-reflecting plate installed to face the device. The irradiation-type photosensor will be described with reference to FIG. 8. As shown in FIG. 8, a light-radiation device 22 and a light-reception device 23 are arranged at the inner surface of a reserve tank 21 to face each other. The optical axis of the light-radiation device 22 extends along a horizontal direction. A stirring pin 24 is formed in the middle of the reserve tank 21 to be capable of rotating. Like the stirring pins 3, 11, 12, 13, and 15 in the first through fifth embodiments of the present invention, the stirring pin 24 is also formed to have a middle space along its rotation axis. Accordingly, light emitted from the light-radiation device 22 is rarely blocked by the stirring pin 24, and thus the light-reception device 23 can receive the light.

Here, the amount of toner 25 remaining in the reserve tank 21 is measured based on the amount of light received by the light-reception device 23. In other words, if the amount of the toner 25 remaining in the reserve tank 21 is considered appropriate, light 26 radiated from the light-radiation device 22 is diffused by the toner 25 stirred by the stirring pin 24, and accordingly, the amount of light received by the light-reception device 23 decreases. On the other hand, if the amount of the toner 25 left in the reserve tank 21 is small, the light emitted from the light radiation device 22 is rarely diffused even when stirring the toner 25 with the stirring pin 24, and accordingly, the amount of light received by the light-reception device 23 increases. The amount of the toner 25 remaining in the reserve tank 21 can be detected based on the amount of light received by the light-reception device 23.

In the present embodiment, the amount of the toner 25 remaining in a reserve tank can be detected in real time by forming a stirring pin 24 to have a middle space and to detect the amount of light passing through the middle space of the stirring pin 24.

In general, in the case of a small-sized reserve tank 21, the amount of the toner 25 stored in the reserve tank 21 is small and decreases very quickly. However, according to the present embodiment, the amount of the toner 25 can be detected in real time, and thus it is possible to supply the toner 25 from a toner cartridge to the reserve tank 21 at the right time whenever it is necessary. In addition, it is possible to appropriately respond to the drastic decrease in the amount of the toner 25 in the reserve tank 21. It is also possible to control the rotation of the stirring pin 24 depending on the amount of the toner 25 left in the reserve tank 21 and to precisely control the stirring and spreading of the toner 25.

Figure 10:
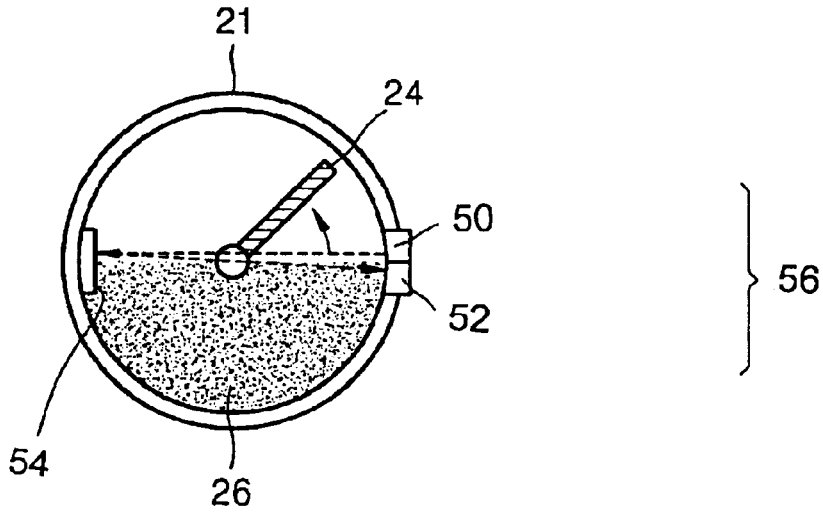
FIG. 10 is a diagram including a reflection-type photosensor.

A reflection-type photosensor has the same operation and effects in terms of the detection of the amount of toner in a reserve tank as the radiation-type photosensor described above. FIG. 10 illustrates the reflection-type photosensor 56 having a light emitting portion 50, a light receiving portion 52 and a reflection plate 54.

Figure 9:
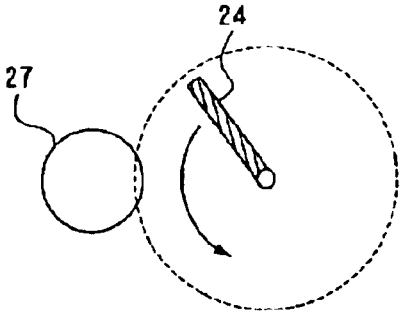
FIG. 9 is a diagram illustrating the relationship between a stirring pin and a supply roller according to a sixth embodiment of the present invention.

FIG. 9 is a diagram illustrating the positional relationship between the stirring pin 24 and a supply roller 27. A powder stirring device has a structure in which the locations of the stirring pin 24 and the supply roller 27 can vary.

As shown in FIG. 9, the supply roller 27 to supply toner to a development unit is arranged near the stirring pin 24. The stirring pin 24 is arranged so that its rotation circumference can contact the circumference of the supply roller 27. Thus, when the stirring pin 24 rotates, the end of the stirring pin 24 can contact the supply roller 27. As a result, toner attached to the surface of the supply roller 27 is wiped off by the stirring pin 24, and thus new toner can be continuously supplied to the development unit by the supply roller.

As described above, the present invention provides the following effects.

First, in a small-sized image forming device, such as a printer, it is possible to effectively stir and spread toner. Accordingly, a powder stirring device can be manufactured to have a simpler structure, and manufacturing costs are reduced. In particular, in the case of applying the present invention to a color printer using a plurality of reserve tanks, it is possible to reduce the size and manufacturing costs of such an image forming device more. Moreover, these days, a photocopier or a printer has been required to be manufactured in a compact size. The more the structure of a reserve tank is simplified, the more considerably the size and manufacturing costs of an electrophotographic developing device can be reduced.

Second, in a conventional printer, a reserve tank is installed in a toner cartridge. Thus, the structure of the toner cartridge is complicated, and the price of the toner cartridge is high. Accordingly, it is expensive and difficult to replace the toner cartridge. However, according to the embodiments of the present invention, it is possible to simplify the toner cartridge structure, and thus reduce the manufacturing costs of a toner cartridge by simplifying the structure of a reserve tank.

Third, a piezoelectric sensor, which has been conventionally used as a toner sensor, may cause a time lag in detecting the amount of toner in a reserve tank. However, in the present invention, an optical sensor can be used as a toner sensor, since a stirring pin to stir and spread toner is formed to have a middle space. In addition, it is possible to detect the amount of toner at high speeds. Accordingly, it is possible to precisely detect the amount of toner in real time and to control the amount of toner in a reserve tank at an optimal level. Moreover, it is possible to appropriately control a power of stirring and spreading power depending on the amount of toner remaining in the reserve tank.

According to the present invention, as described above, a stirring element is provided to be supported while rotating and stirring toner in the reserve tank, and thus it is possible to effectively stir toner, even though the present invention has a simple structure. In addition, it is possible to detect the amount of toner in real time by using an optical toner sensor together with the stirring element.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A powder stirring device, which stirs toner to be provided to a development unit of an image forming device, the powder stirring device comprising:

a reserve tank having a rotation axis;

a stirring element which is supported in the reserve tank, the stirring element being arranged away from the rotation axis of the reserve tank or a region adjacent to the rotation axis, to rotate in the reserve tank; and a unit to detect the amount of the toner in the reserve tank, wherein the unit to detect the amount of the toner in the reserve tank is in optical sensor which detects an amount of light passing through a region in the reserve tank where the toner is stirred.

2. The powder stirring device of claim 1, further comprising a supply roller which is provided in a vicinity of the stirring element to provide the toner to the development unit, wherein the stirring element is arranged so that a rotation circumference thereof contacts the supply roller.

3. A powder stirring device, which stirs toner to be provided to a development unit of an image forming device, the powder stirring device comprising:

a reserve tank having a rotation axis;

a stirring element which is supported in the reserve tank, the stirring element being arranged away from the rotation axis of the reserve tank or a region adjacent to the rotation axis, to rotate in the reserve tank; and a unit to detect the amount of the toner in the reserve tank, wherein the stirring element is formed in a bar shape and is arranged in parallel with the rotation axis of the reserve tank, and the unit to detect the amount of the toner in the reserve tank is an optical sensor which detects an amount of light passing through a region in the reserve tank where the toner is stirred.

4. The powder stirring device of claim 3, further comprising a supply roller which is provided in a vicinity of the stirring element to provide the toner to the development unit, wherein the stirring element is arranged so that a rotation circumference thereof contacts the supply roller.

5. A powder stirring device, which stirs toner to be provided to a development unit of an image forming device, the powder stirring device comprising:

a reserve tank having a rotation axis;

a stirring element which is supported in the reserve tank, the stirring element being arranged away from the rotation axis of the reserve tank or a region adjacent to the rotation axis, to rotate in the reserve tank; and a unit to detect the amount of the toner in the reserve tank, wherein the stirring element is formed in a crank shape, and the unit to detect the amount of the toner in the reserve tank is an optical sensor which detects an amount of light passing through a region in the reserve tank where the toner is stirred.

6. The powder stirring device of claim 5, further comprising a supply roller which is provided in a vicinity of the stirring element to provide the toner to the development unit, wherein the stirring element is arranged so that a rotation circumference thereof contacts the supply roller.

7. A powder stirring device, which stirs toner to be provided to a development unit of an image forming device, the powder stirring device comprising:

a reserve tank having a rotation axis;

a stirring element which is supported in the reserve tank, the stirring element being arranged away from the rotation axis of the reserve tank or a region adjacent to the rotation axis, to rotate in the reserve tank; and a unit to detect the amount of the toner in the reserve tank, wherein the stirring element is formed in a spiral shape, and the unit to detect the amount of the toner in the reserve tank is an optical sensor which detects an amount of light passing through a region in the reserve tank where the toner is stirred.

8. The powder stirring device of claim 7, further comprising a supply roller which is provided in a vicinity of the stirring element to provide the toner to the development unit, wherein the stirring element is arranged so that a rotation circumference thereof contacts the supply roller.

9. A powder stirring device, which stirs toner to be provided to a development unit of an image forming device, the powder stirring device comprising:

a reserve tank having a rotation axis;

a stirring element which is supported in the reserve tank, the stirring element being arranged away from the rotation axis of the reserve tank or a region adjacent to the rotation axis, to rotate in the reserve tank, wherein the stirring element comprises:

a pair of bars, which are symmetrically arranged with respect to the rotation axis of the reserve tank and parallel to the rotation axis of the reserve tank, and ribs, which are formed along a rotation circumference of the pair of bars and are slantingly connected to the pair of bars; and a unit to detect the amount of the toner in the reserve tank, wherein the unit to detect the amount of the toner in the reserve tank is an optical sensor which detects an amount of light passing through a region in the reserve tank where the toner is stirred.

10. The powder stirring device of claim 9, further comprising a supply roller which is provided in a vicinity of the stirring element to provide the toner to the development unit, wherein the stirring element is arranged so that the rotation circumference thereof contacts the supply roller.

11. A powder stirring device, which stirs toner to be provided to a development unit of an image forming device, the powder stirring device comprising:

a reserve tank having a rotation axis;

a stirring element which is supported in the reserve tank, the stirring element being arranged away from the rotation axis of the reserve tank or a region adjacent to the rotation axis, to rotate in the reserve tank; and a supply roller which is provided in a vicinity of the stirring element to provide the toner to the development unit, wherein the stirring element is arranged so that a rotation circumference thereof contacts the supply roller.

12. A powder stirring device, which stirs toner to be provided to a development unit of an image forming device, the powder stirring device comprising:

a reserve tank having a rotation axis;

a stirring element which is supported in the reserve tank, the stirring element being arranged away from the rotation axis of the reserve tank or a region adjacent to the rotation axis, to rotate in the reserve tank; and a supply roller which is provided in a vicinity of the stirring element to provide the toner to the development unit, wherein the stirring element is formed in a bar shape and is arranged in parallel with the rotation axis of the reserve tank, and the stirring element is arranged so that a rotation circumference thereof contacts the supply roller.

13. A powder stirring device, which stirs toner to be provided to a development unit of an image forming device, the powder stirring device comprising:

a reserve tank having a rotation axis;

a stirring element which is supported in the reserve tank, the stirring element being arranged away from the rotation axis of the reserve tank or a region adjacent to the rotation axis, to rotate in the reserve tank; and a supply roller which is provided in a vicinity of the stirring element to provide the toner to the development unit, wherein the stirring element is formed in a crank shape, and the stirring element is arranged so that a rotation circumference thereof contacts the supply roller.

14. A powder stirring device, which stirs toner to be provided to a development unit of an image forming device, the powder stirring device comprising:

a reserve tank having a rotation axis;

a stirring element which is supported in the reserve tank, the stirring element being arranged away from the rotation axis of the reserve tank or a region adjacent to the rotation axis, to rotate in the reserve tank; and a supply roller which is provided in a vicinity of the stirring element to provide the toner to the development unit, wherein the stirring element is formed in a spiral shape, and the stirring element is arranged so that a rotation circumference thereof contacts the supply roller.

15. A powder stirring device, which stirs toner to be provided to a development unit of an image forming device, the powder stirring device comprising:

a reserve tank having a rotation axis;

a stirring element which is supported in the reserve tank, the stirring element being arranged away from the rotation axis of the reserve tank or a region adjacent to the rotation axis, to rotate in the reserve tank, wherein the stirring element comprises:

a pair of bars, which are symmetrically arranged with respect to the rotation axis of the reserve tank and parallel to the rotation axis of the reserve tank, and ribs, which are formed along a rotation circumference of the pair of bars and are slantingly connected to the pair of bars; and a supply roller which is provided in a vicinity of the stirring element to provide the toner to the development unit, wherein the stirring element is arranged so that a rotation circumference thereof contacts the supply roller.

16. A device to stir toner, comprising:

a tank to store the toner;

a stirring element to rotate about an axis and thereby stir the toner, the stirring element comprising first and second pin elements and forming a space along the axis; and a shaft to drive the stirring element, the shaft passing through the axis, wherein a stirring power of the first and second pin elements is varied by varying a rotation speed of the shaft, and wherein the stirring power of the pin elements is varied according to an amount of the toner remaining in the tank.

17. The printer of claim 16, further comprising a piezoelectric sensor to detect the amount of toner supplied to the tank.

18. A printer, comprising:

a tank to store toner;

a stirring element to rotate about an axis and thereby stir the toner, the stirring element forming a space along the axis; and a toner supply to supply the toner to the tank, wherein an amount of the toner to be supplied to the tank is determined in real time.

19. The printer of claim 18, further comprising:

a light radiating device to radiate light through the space; and a light receiving device to receive the radiated light and determine the amount of the toner to be supplied based upon the received light.

20. The printer of claim 18, further comprising a reflection-type photosensor to determine the amount of toner to be supplied based upon a detected amount of light.

21. The printer of claim 18, wherein the toner supply is a supply roller, and the stirring element contacts a surface of the supply roller to wipe the toner attached to the surface of the supply roller.

22. A printer, comprising:

a tank to store toner;

a stirring element to rotate about an axis and thereby stir the toner, the stirring element forming a space along the axis;

an optical sensor to determine an amount of the toner in the tank from an amount of detected light; and a toner supply to supply the toner to the tank according to the sensed amount of toner.

* * * * *